United States Patent [19]

Betsui

[11] Patent Number: 4,749,372

[45] Date of Patent: Jun. 7, 1988

[54] ELECTRICAL CONNECTOR HAVING DOUBLE LOCK ARRANGEMENT FOR THE ELECTRICAL CONTACTS

[75] Inventor: Kazuhisa Betsui, Tokyo, Japan

[73] Assignee: AMP Incorporated, Harrisburg, Pa.

[21] Appl. No.: 4,387

[22] Filed: Jan. 16, 1987

[30] Foreign Application Priority Data

Feb. 12, 1986 [JP] Japan ..... 61-018749[U]

[51] Int. Cl.[4] ..... A01R 13/40

[52] U.S. Cl. ..... 439/587

[58] Field of Search ..... 339/59–61, 339/63, 94 R, 94 M; 439/586–589, 592, 593, 599, 603, 273, 281, 282

[56] References Cited

U.S. PATENT DOCUMENTS 3,937,545 2/1976 Cairns et al. ..... 339/60 R
4,557,542 12/1985 Coller et al. ..... 339/59 M
4,602,837 7/1986 Sian et al. ..... 339/59 M
4,684,190 8/1987 Clark et al. ..... 439/587

*Primary Examiner*—Gil Weidenfeld
*Assistant Examiner*—Paula A. Austin
*Attorney, Agent, or Firm*—A. John LaRue; Robert W. Pitts

[57] ABSTRACT

An electrical connector comprises a dielectric housing having passageways extending therethrough in which electrical contacts are positioned. Resilient latching arms are provided by the housing, and they have latching projections engaging the contacts thereby retaining the contacts in the passageways; the resilient latching arms having locking plate slots opposite the latching projections. Locking plate means is inserted into the housing into the locking plate slots limiting projections of the resilient arms thereby maintaining the latching projections in latching engagement with the contacts.

3 Claims, 3 Drawing Sheets

ELECTRICAL CONNECTOR HAVING DOUBLE LOCK ARRANGEMENT FOR THE ELECTRICAL CONTACTS

FIELD OF THE INVENTION

This invention is related to an electrical connector having a plurality of electrical contacts, each of which is connected to, for example, an electrical wire, inside the connector housing. These contacts are electrically engaged with corresponding electrical contacts of another connector, thus, causing an electrical connection of, for example, the wires connected to each contact.

More particularly, the present invention is directed to an electrical connector comprising a dielectric housing having passageways in which electrical contacts are positioned. Integral resilient latching members are provided by the housing which are in latching engagement with the contacts thereby retaining the contacts in position in the passageways. A comb-shaped member is inserted into the housing and has plates that extend between the resilient latching members maintaining the latching members in their latched positions. Notches are located in the comb-shaped member to separate the plates from a carrier strip and holes are located in the plates forming resilient sections that are press-fitted into passageway walls thereby retaining the plates in position in the housing.

As shown in FIG. 6, this prior art connector comprises a male housing 1 which receives and retains a plurality of receptacle contacts 2 having end portions of wires 3 connected therewith, and a female housing 7 which receives and retains a pluraility of plug contacts 8 to which end portions of other wires 3 are connected. In this case, when the receptacle contacts 2 are received inside the male housing 1, an engaging projection 5, which is provided at the end portion of a resilient arm or resilient lance 4 formed as an integral part of the male housing 1, retains the contact 2 inside the housing 1 by engaging with the receptacle contact 2. The arm 4 is made to be resilient so that it will not obstruct the engaging projection 5 when the contact 2 is inserted into the housing 1. Due to this resilience, however, a problem arises in that the receptacle 2 may slip out because the arm 4 can be elastically deformed if a strong pulling force is exerted on the wire 3. For this reason, the connector shown in FIG. 6 has a space 6 formed between the arms 4 in the male housing 1, and a plate 9 is formed opposite to the space 6 in the female housing 7. Accordingly, when the housings 1,7 are mated, the plate 9 enters into the space 6 to prevent the engaging projection 5 from being pulled out, by limiting the elastic deformation of the arms 4, and thus prevents the receptacles 2 from slipping out of the housing. However, it is difficult to insert the plate 9 into the space 6 properly when engaging the connectors, and therefore, a problem arises wherein if, for example, the connector is forcibly inserted at an angle then plate 9 may possibly be damaged. If the plate 9 is damaged, the female housing itself must be replaced, and thus, a problem arises due to an increase in the replacement cost of the parts. This problem of damage to the plate 9 may occur further by frequent connection and disconnection of the male and female connectors.

SUMMARY OF THE INVENTION

In consideration of the aforementioned problems, the object of this invention is to provide an electrical connector that eliminates the problem of damage to the plate mentioned above, and also limits the elastic deformation of the resilient latch arms after the contacts are inserted, and thus each contact is retained inside the connector housing by the engaging projection of the resilient latch arm.

The connector of this invention is characterized in a connector housing that receives and retains an electrical contact in a passageway which is formed inside the connector housing, a resilient arm of the housing projecting into the passageway and provided with an engaging projection which engages the contact thereby retaining the contact in the housing. A locking plate insertion slot is provided in the latching arm opposite the engaging projection of the resilient latch arm, and thus elastic deformation of the resilient arm is limited by inserting a locking plate into the locking plate insertion slot. Accordingly, retention of the engaging projection of the latch arm with the contact is ensured.

The locking plate includes a resilient section that is press-fitted into engagement with the passageway walls therby retaining the locking plate in the housing.

If an electrical contact is improperly latched in position in a contact-receiving passageway of the housing, the locking plate will not be able to be positioned in the housing to maintain the resilient latching arm in a latched position with the contact thereby indicating that the contact has not been properly latched in position in the passageway.

BRIEF DESCRIPTION OF THE INVENTION

Figure 1:
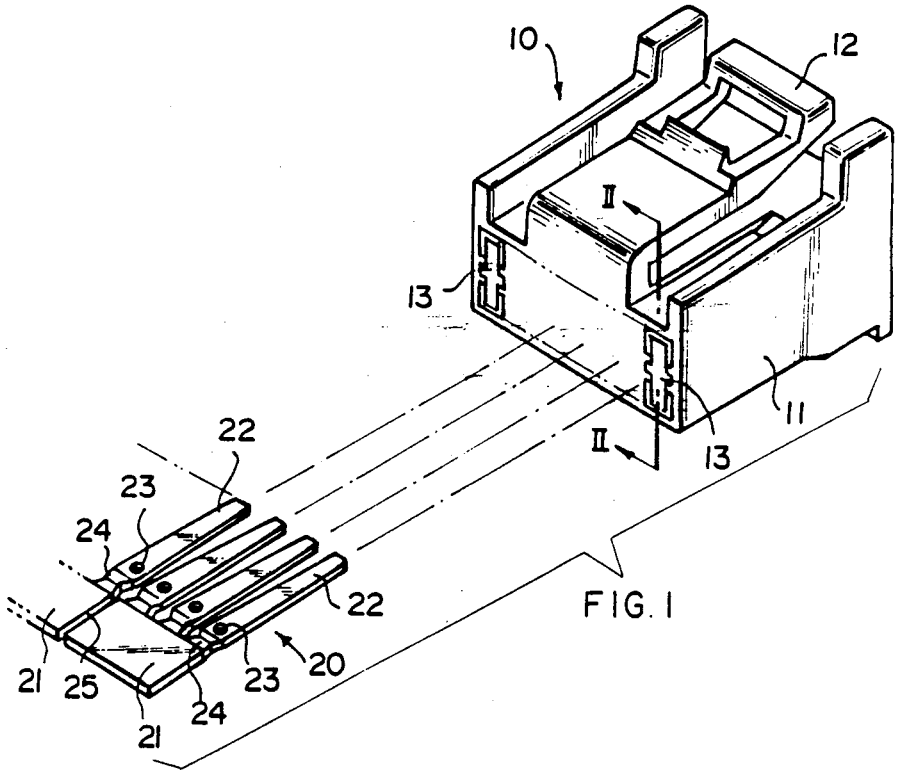
FIG. 1 is a perspective view of the connector according to this invention.
Figure 2A:
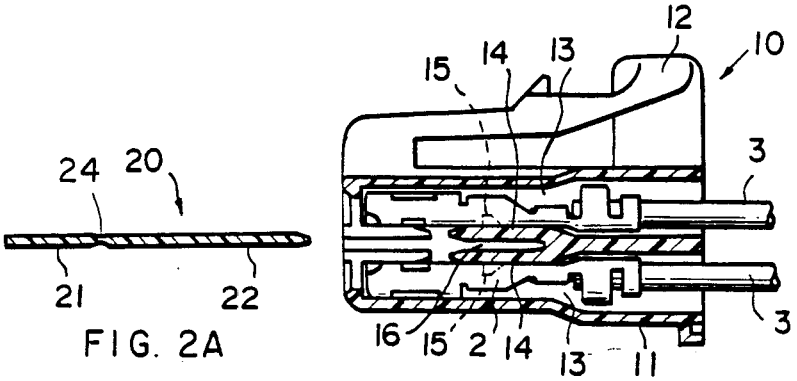
FIGS. 2A to 2C are cross sectional views showing the connector along the lines II—II in FIG. 1.
Figure 2B:
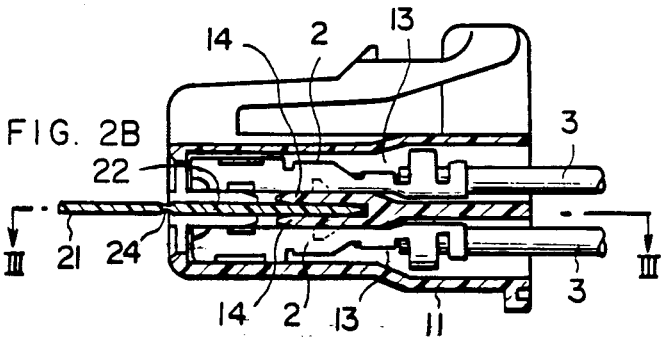
Figure 5:
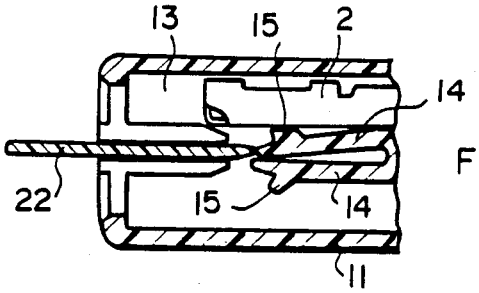
Figure 6:
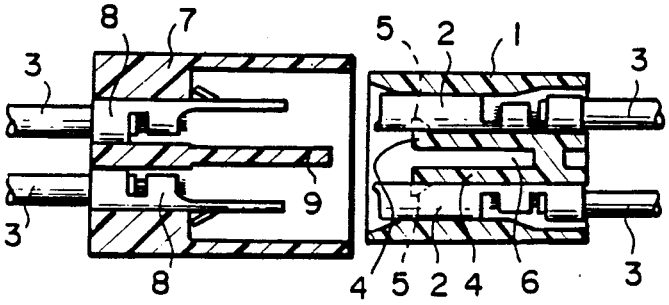

FIGS. 3A and 3B, and FIGS. 4A and 4B are cross sectional views showing the locking plate inserted into the connector along the line III—III of FIG. 2B;

FIG. 5 is a cross sectional view showing the front portion of the connector along the line II—II in FIG. 1;

FIG. 6 is a cross sectional view of the prior art connector.

DETAILED DESCRIPTION OF THE INVENTION

The following is a description of the preferred embodiment of this invention, with reference to the accompanying drawings.

Figure 2C:
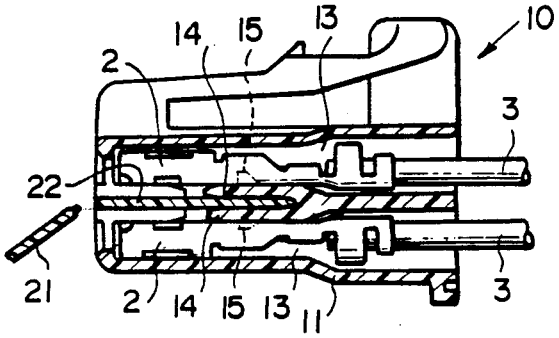

The connector 10 as shown in FIGS. 1–2C comprises a housing 11 and a plurality of contacts 2 received in the housing 11. As shown in FIG. 2A, the contacts 2 are respectively connected to end portions of wires 3 and respectively received in a plurality of passageways 13 formed inside the connector housing 11. Further, a resilient latching member 12, which is formed at the upper surface of the connector housing 11, is used for latching both housings when the connector 10 is mated with another connector. Also, resilient arms 14 are integrally formed from housing 11 which extend from the rear portion toward the front portion inside the connector housing 11, and a locking plate insertion slot 16 which extends from the rear portion toward the front portion is formed between opposed resilient arms 14.

Note, in FIGS. 2A to 2C, the portion on the left is the front portion and the portion on the right is the rear portion. The resilient arms 14 respectively are provided with engaging projections 15 which project into passageways 13. Therefore, when the contacts 2 are inserted into the passageways 13 from the rear portion, the contacts can be smoothly inserted since the resilient arms 14 are elastically deformed and since the engaging projections 15 are depressed to allow the contacts to be inserted into the passageways. When the insertion is completed, the engaging projections 15 are engaged within apertures in the contacts 2 by the elastic force created by the resilient arms 14, and thus the contacts 2 are retained in the passageways and prevented from being removed, if an external force is applied to the wires. However, since the resilient arms 14 are still elastically deformable, it is possible that the engagement of the engaging projections 15 and the contacts 2 can be disconnected by elastic deformation of the resilient arms 14.

Therefore, according to this invention, a locking plate assembly 20 is press-fitted into locking plate insertion slots 16 from the front portion of the housing to prevent this elastic deformation of the arms and to provide a double lock arrangement. FIGS. 2A to 2C show locking plate 22 being inserted from the front portion of the housing 11 into slot 16.

As shown in FIG. 1, the locking plate 20 assembly comprises a plurality of plates 22 and a carrier 21 which is integral with and supports these plates. Carrier 21 is divided by notches 25 into portions each of which supports three of these plates 22, for example, as shown in FIG. 1. Thus, carrier 21 can be separated into separate pieces, each supporting three or more of the plates 22, by cutting carrier 21 at notches 25. This enables plates 22 to be mass inserted into position in housing 11. Also, notches 24 are formed between the carrier 21 and plates 22. Thus, each plate 22 can be separated from the carrier 21 by cutting the notches 24 or breaking carrier 21 from plates 22 via notches 24 after plates 22 are in position in housing 11.

Therefore, as shown in FIG. 2C, after the plates 22 are press-fitted into the locking plate insertion slots 16, the carrier or carriers 21 are bent and cut off or broken off plates 22 at the notch 24. Accordingly, when the plates 22 are press-fitted inside the locking plate insertion slots 16, movement of the resilient arms 14 is limited by plates 22, and thus the engaging projections 15 which are provided by the resilient arms 14 can be retained in engagement with the contacts 2, and accordingly, the contacts 2 are prevented from being removed thereby retaining the contacts in position in the passageways and resulting in a double lock arrangement.

Figure 3A:
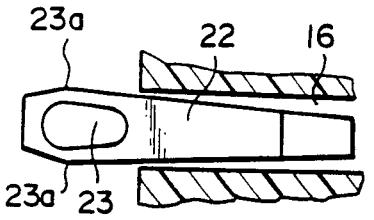
Figure 3B:
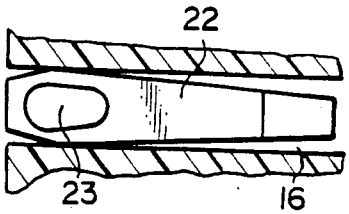

As FIGS. 3A and 3B show, an end portion of the plate 22 has an oblong hole 23 located close to the carrier 21. The side portions 23*a* of the latching hole 23 are slightly larger than the width between passageway walls, and therefore, as the plate 22 is inserted into the insertion slot 16, the side portions 23*a* are resiliently deformed by the passageway walls, and thus the plate 22 is press-fitted into the insertion slot 16 and at the same time, retained between the passageway walls by resilient side portions 23*a* frictionally engaging the passageway walls. Further, after inserting the plate 22 into the insertion slot 16, if the plate 22 must be pulled out again, the plate 22 can be pulled out by use, for example, of an extraction tool having a hook which is positioned into the latching hole 23.

Figure 4A:
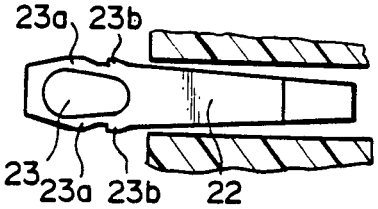
Figure 4B:
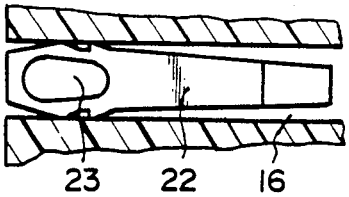

Furthermore, as shown in FIGS. 4A and 4B, the plate 22 has small projections 23*b* formed in the side portions 23*a*, and the plate 22 can be press-fitted between the passageway walls when these projections 23*b* and trailing parts of side portions 23*a* frcitionally engage the passageway walls.

According to the connector of this invention, as shown in FIG. 5, if the contact 2 is incorrectly positioned after the contact 2 is inserted in the passageway 13 of the connector housing 11, then the engaging projection 15 is pressed downwardly by the contact 2 and the resilient arm 14 remains elastically deformed. Therefore, the tip of the plate 22 comes into contact with the tip of the resilient arms 14, and cannot be further inserted. Accordingly, a contact that has not been properly latched in position in passageway 13 by projection 15 can be easily detected.

As explained above, according to this invention, since the resilient arms are provided with engaging projections which latchably engage with the electrical contacts when inserted inside the passageways of the connector housing, and the locking plate insertion slots are formed opposite to the engaging projections of the arms, elastic deformation of the resilient arms is limited by inserting locking plates into the locking late insertion slots, which ensure secure engagement between the engaging projections and the contacts and thus prevent the contacts from being removed from their passageways thereby resulting in a double lock arrangement to positively maintain the contacts in the passageways. Insertion of the locking plates into the locking plate insertion slots also indicates the contacts are properly latched into position in the passageways.

I claim:

1. An electrical connector, comprising:

a dielectric housing having passageway means extending therethrough;

electrical contact means positioned in said passageway means;

resilient latching means provided by said housing and having latching-projection means engaging said contact means thereby retaining said contact means in said passageway means, said housing having locking plate-receiving means adjacent said resilient latching means;

locking plate means having first section means and second section means separable from said first section means, said second section means, insertable in said locking plate-receiving means, limiting movement of said resilient latching means thereby maintaining said latching-projection means in latching engagement with the contact means; and means maintaining said second section means in said housing whereafter said first section means is separable from said second section means.

2. An electrical connector, comprising:

a dielectric housing having passageways extending therethrough;

electrical contacts positioned in respective passageways;

resilient latching arms provided by said housing and having latching projections engaging said contacts retaining said contacts in said passageways, said resilient latching arms having locking plate slots opposite said latching projections;

locking plate means inserted into said housing into said locking plate slots limiting movement of the resilient arms thereby maintaining said latching projections in latching engagement with the contacts, said locking plate means comprising a locking plate assembly including a carrier strip from which extend locking plates at spaced intervals along said carrier strip;

notches located in said carrier strip to enable said carrier strip to be separated at said notches into separate carrier strips having a specified number of locking plates thereon to enable the locking plates to be mass inserted into said housing; and means maintaining said locking plate means in said housing and in said locking plate slots.

3. An electrical connector as claimed in claim 2, wherein notches are located in said locking plates adjacent said carrier strip enabling said carrier strip to be separated at said notches from said locking plates after the locking plates have been inserted into said housing within said locking plate slots.

* * * * *